United States Patent [19]

Yamato

[11] Patent Number: 4,495,927

[45] Date of Patent: Jan. 29, 1985

[54] METHOD FOR CONTROLLING THE OPERATION OF AN INTERNAL COMBUSTION ENGINE AT THE START OF SAME

[75] Inventor: Akihiro Yamato, Shiki, Japan

[73] Assignee: Honda Giken Kogyo Kabushiki Kaisha, Tokyo, Japan

[21] Appl. No.: 505,069

[22] Filed: Jun. 16, 1983

[30] Foreign Application Priority Data

Jun. 18, 1982 [JP] Japan ..... 57-104804

[51] Int. Cl.[3] ..... F02N 17/00; F02M 51/00

[52] U.S. Cl. ..... 123/491; 123/179 L; 123/424

[58] Field of Search ..... 123/179 L, 480, 491, 123/424; 364/431.1

[56] References Cited

U.S. PATENT DOCUMENTS

| | | | |
|---|---|---|---|
| 4,310,888 | 1/1982 | Furuhashi et al. | 123/491 X |
| 4,372,274 | 2/1983 | Takase | 123/424 X |
| 4,378,770 | 4/1983 | Ikeura | 123/424 |
| 4,416,234 | 11/1983 | Ikeura | 123/424 |

FOREIGN PATENT DOCUMENTS

| | | | |
|---|---|---|---|
| 2037458 | 7/1980 | United Kingdom | 123/491 |

*Primary Examiner*—Tony M. Argenbright
*Attorney, Agent, or Firm*—Lyon & Lyon

[57] ABSTRACT

A method for controlling an internal combustion engine at the start of same, by means of a control system for controlling the operation of the engine, which includes a central processing unit normally operable with an operating voltage higher than a predetermined voltage. The central processing unit is adapted to be reset when the operating voltage rises across the above predetermined voltage after closing of the ignition switch of the engine. A plurality of different control manners are selectively applied for control of the operation of the engine, depending upon the position of the starter switch for actuating the starter of the engine, assumed during initialization of the central processing unit. The internal combustion engine includes a multi-cylinder engine, and the engine operation control system includes a fuel injection control system. Preferably, if the starter switch is in an open position during initialization of the central processing unit, a first control manner is selected wherein fuel injections are effected into all the engine cylinders at the same time in synchronism with generation of a first output pulse from a top-dead-center sensor after completion of the initialization of the central processing unit, and if the starter switch is in a closed position during the initialization, a second control manner is selected wherein fuel injections are effected into all the engine cylinders at the same time in synchronism with generation of a first output pulse from a cylinder-discriminating sensor after completion of the initialization. Following the fuel injection according to the first or second control manner selected, fuel injections are effected into the engine cylinders in a successive manner in synchronism with generation of output pulses from the top-dead-center sensor.

11 Claims, 10 Drawing Figures

INTERNAL COMBUSTION ENGINE
CYLINDERS
1
1a
CYLINDER-DISCRIMINATING SENSOR
12
TDC SENSOR
11
FUEL INJECTION DEVICE
6
THROTTLE BODY
3
THROTTLE VALVE OPENING SENSOR
4
2
7
PBA SENSOR
8
ECU
5
CPU
5a
IGNITION SWITCH
14
BATTERY
15
STARTER SWITCH
13

METHOD FOR CONTROLLING THE OPERATION OF AN INTERNAL COMBUSTION ENGINE AT THE START OF SAME

BACKGROUND OF THE INVENTION

This invention relates to a method for controlling the operation of an internal combustion engine at the start of same, and more partiucularly to a method of this kind which is capable of starting the engine in a smooth and stable manner, without spoiling the emission characteristics of the engine.

A fuel injection control system adapted for use with an internal combustion engine, particularly a gasoline engine has been proposed e.g. by U.S. Pat. No. 3,483,851, which is adapted to determine the valve opening period of a fuel injection device for control of the fuel injection quantity, i.e. the air/fuel ratio of an air/fuel mixture being supplied to the engine, by first determining a basic value of the above valve opening period as a function of engine rpm and intake pipe absolute pressure and then adding to and/or multiplying same by constants and/or coefficients being functions of engine rpm, intake pipe absolute pressure, engine temperature, throttle valve opening, exhaust gas ingredient concentration (oxygen concentration), etc., by electronic computing means.

According to the above proposed electronic fuel injection control system, when applied to a multi-cylinder engine, a plurality of injectors, which are exclusively provided for the respective cylinders of the engine, are successively actuated in predetermined sequence, in synchronism with generation of pulses of a top-dead-center signal (hereinafter called "the TDC signal"), which are each indicative of a predetermined crank angle of the crankshaft of the engine and are generated in a number equal to the number of the cylinders per cycle of the engine. Determination as to which cylinders the individual pulses of the TDC signal correspond to is made on the basis of the timing of generation of pulses of a cylinder-discriminating signal which are each generated each time the crankshaft rotates through a predetermined angle with respect to a particular cylinder, to thereby carry out fuel injection into the cylinders accurately in predetermined sequence.

However, at the start of the engine, in many cases a first pulse of the above cylinder-discriminating signal is not generated immediately upon starting of the engine, depending upon the angular position of the crankshaft assumed immediately before the start of the engine. In such cases, there can occur a noncoincidence in timing between the suction stroke of a certain cylinder and the valve opening action of the corresponding injector before the first pulse of the cylinder-discriminating signal is generated, so that the supply of fuel into the cylinders is not effected smoothly, preventing smooth and positive starting of the engine.

To eliminate such disadvantage, there has been proposed a method by the assignee of the present application, in which fuel injections are effected into all the cylinders at the same time upon generation of a first pulse of the TDC signal immediately after the start of the engine, thereafter no injection is effected into any of the cylinders until the pistons of all the cylinders have finished their first suction strokes, and after completion of the first suction strokes of all the cylinders, fuel injections are successively effected into the cylinders in predetermined sequence in synchronism with generation of subsequent pulses of the TDC signal (Japanese Patent Provisional Publication No. 57-137626).

However, this proposed method has the weekpoint that when the supply voltage or operating voltage to a central processing unit (hereinafter called "CPU") which forms essential part of electronic control means for carrying out the method can often drop after the start of the engine in cold weather, the CPU is initialized each time the supply voltage recovers its normal level so that concurrent fuel injections into all the cylinders repeatedly take place several times. In other words, in cold starting of the engine, the supply voltage supplied to the CPU from a battery can drop below a lower limit of a range within which the CPU can normally operate, upon closing of a starter switch which, when closed, actuates the starter of the engine which is driven by the same battery. When the supply voltage from the battery drops below the above lower limit, the CPU is reset, and when the supply voltage subsequently recovers a level above the lower limit, the CPU is released from its reset state and initialized. Immediately after actuation of the starter, the supply voltage can repeatedly drop below the lower limit, and accordingly the CPU is initialized repeatedly. A concurrent fuel injection into the all the cylinders takes place upon each initialization of the CPU. As a consequence, an excessive amount of fuel is supplied to the engine, which badly affects not only the operation of the engine but also the emission characteristics and fuel consumption of the engine.

BACKGROUND OF THE INVENTION

It is the object of the invention to provide a method for controlling the operation of an internal combustion engine at the start of same, which enables positive and smooth starting of the engine, even when there occur fluctuations in the supply voltage to an engine operation control system including a CPU which is adapted to normally operate with a supply voltage above a certain level.

According to the invention, there is provided a method for controlling the operation of an internal combustion engine while it is in a starting condition, by means of a control system including a CPU which is supplied with a supply voltage or operating voltage from a power source while the ignition switch of the engine is closed, and adapted to normally operate with an operating voltage above a predetermined level. The method according to the invention is characterized by comprising the following steps: (1) detecting the value of the above operating voltage being supplied from the power source to the CPU; (2) initializing the CPU when the operating voltage increases above the above predetermined level after the ignition switch has been closed; (3) determining whether the starter switch of the engine is in a closed position or in an open position while the CPU is being initialized; (4) selecting one of a plurality of predetermined manners of controlling the operation of the engine while it is in a starting condition, depending upon the result of the determination in the step (3); and (5) controlling the operation of the engine while it is in a starting condition, in accordance with the above one manner selected in the step (4).

The above-mentioned control system includes a fuel injection control system which also controls fuel injection into the engine at the start of same. Prefeably, the above internal combustion engine includes a multi-cylinder engine, and the fuel injection control system includes a top-dead-center sensor adapted to generate a pulse indicative of a predetermined position of a piston in each of different cylinders of the engine relative to a top dead center of the piston, and a cylinder-discriminating sensor adapted to generate a pulse each time the crankshaft of the engine rotates through a predetermined angle with respect to a predetermined position of a piston in a particular cylinder of the engine. The aforementioned control manners selected in the step (4) includes a first fuel injection manner of effecting fuel injections into all the cylinders at the same time in synchronism with generation of a first pulse outputted from the top-dead-center sensor after completion of the above initialization of the CPU, and a second fuel injection manner of effecting fuel injections into all the cylinders in synchronism with generation of a first pulse outputted from the cylinder-discriminating sensor after completion of the above initialization of the CPU. Further preferably, when the starter switch is in an open position during the initialization of the CPU, the first control manner is selected, and when it is in a closed position during the initialization of the CPU, the second control manner is selected. After the fuel injections have been effected according to the first or second control manner selected, fuel injections are successively effected into the respective cylinders in synchronism with generation of pulses subsequently outputted from the top-dead-center sensor.

Also preferably, the engine is determined to be in the aforementioned starting condition, if the starter switch is in a closed position and the rotational of the engine is lower than a predetermined value of rpm.

The above and other objects, features and advantages of the invention will be more apparent from the ensuing detailed description taken in conjunction with the accompanying drawings.

DETAILED DESCRIPTION

The invention will now be described in detail with reference to the drawings showing an embodiment thereof.

Figure 1:
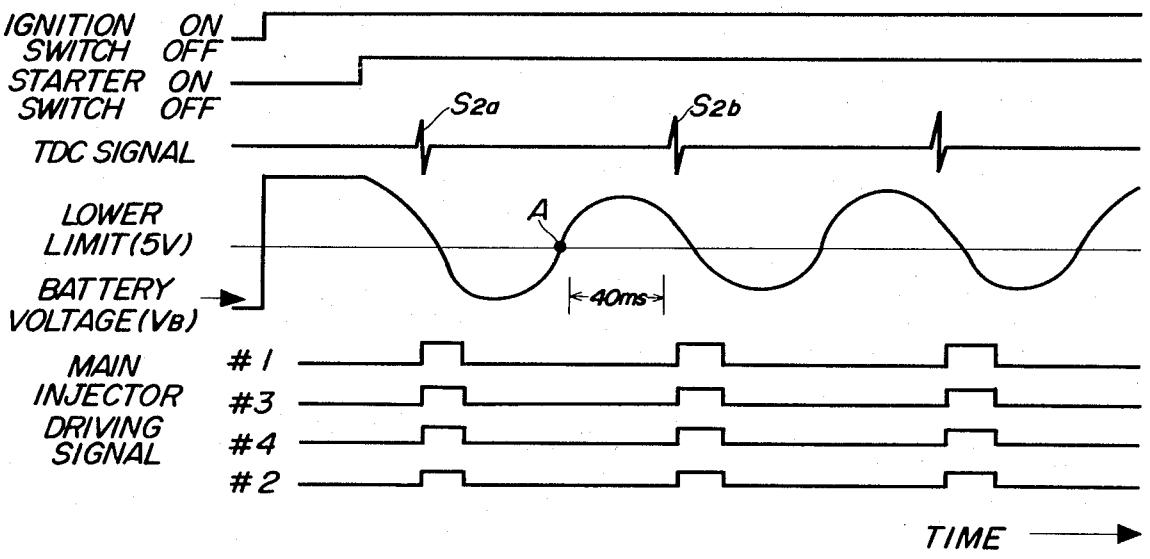
FIG. 1 (PRIOR ART)
FIG. 1 is a timing chart showing how concurrent injections repeatedly take place due to drops in the supply voltage to the CPU.

Referring first to FIG. 1, there is shown a timing chart showing how concurrent fuel injections into all the cylinders repeatedly take place due to drops in the supply voltage to a CPU forming essential part of an electronic fuel injection control system at the start of the engine in cold weather. As shown in FIG. 1, when the ignition switch of the engine is turned on or closed, a supply voltage from a battery is first supplied to the CPU at a level which is above a lower limit of a range within which the CPU can normally operate, and on this occasion the CPU is reset by resetting means, not shown, and then initialized into an operative state. Upon inputting of a first pulse $S_2a$ of the TDC signal immediately after completion of the initialization of the CPU, driving signals are applied at the same time to all injectors #1–4 which are disposed to supply fuel into respective ones of four cylinders of a four-cylinder engine, to carry out fuel injections into all the cylinders at the same time. However, in cold weather, the output voltage from the battery can drop below the above-mentioned lower limit upon closing of a starter switch for actuating the starter of the engine, which is also supplied with the supply voltage from the same battery. While the output voltage from the battery remains at a level below the lower limit, the CPU also remains in a reset state, and when the battery output voltage subsequently rises to exceed the lower limit (at point A), the CPU becomes released from its reset state and then initialized, and it takes a pulse $S_2b$ of the TDC signal inputted thereto immediately after its re-initialization, for a first pulse of the TDC signal, to supply driving signals to all the injectors #1–4 at the same time to actuate them. In this way, each time the battery output voltage drops below the lower limit and then recovers its normal level, the CPU is initialized, thus repeating concurrent fuel injections into all the cylinders, badly affecting the emission characteristics and fuel consumption of the engine as well as the operation of same.

Figure 2:
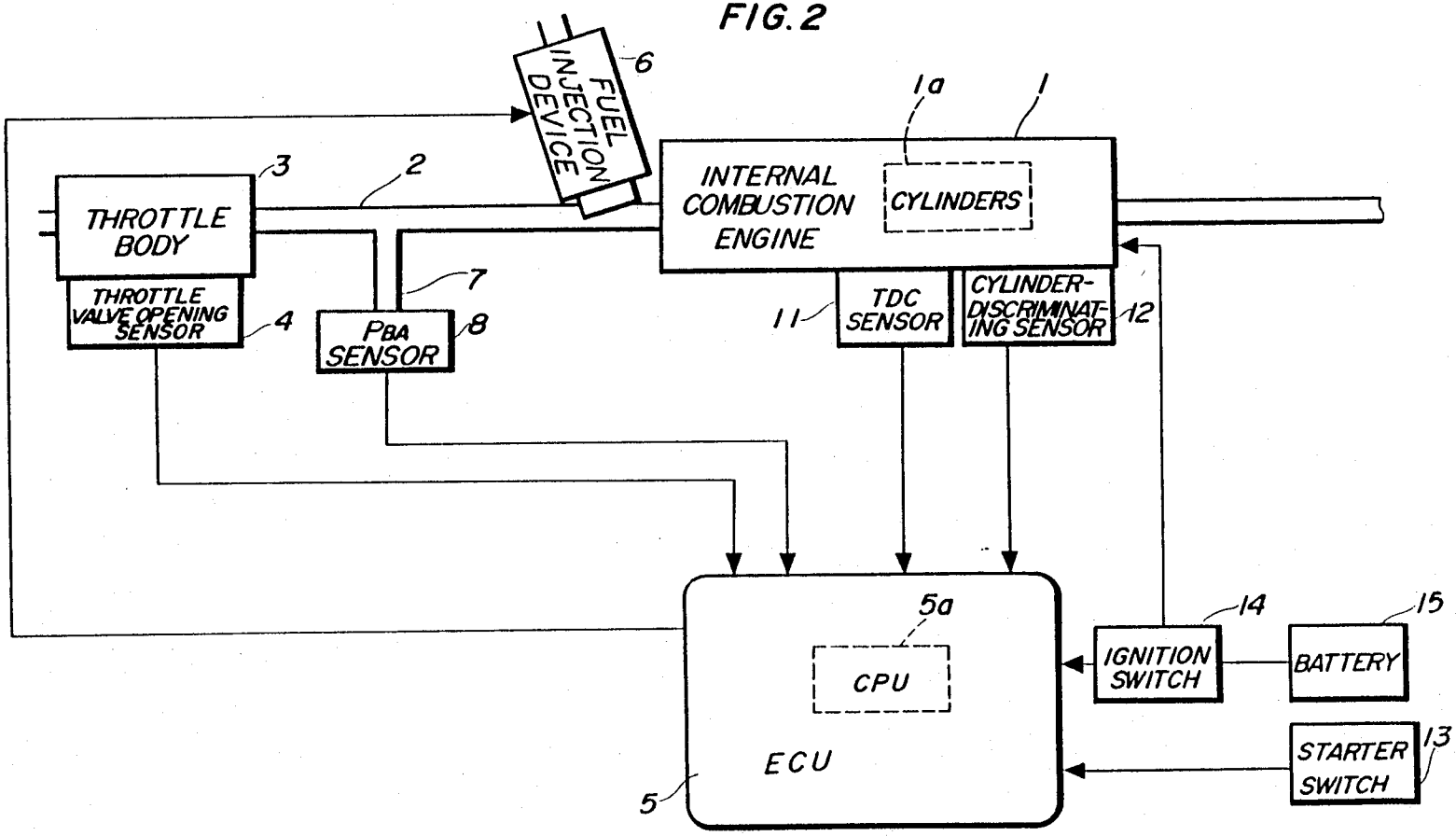
FIG. 2 is a block diagram illustrating the whole arrangement of a fuel injection control system to which is applicable the method according to the present invention.

Referring next to FIG. 2, there is illustrated the whole arrangement of a fuel injection control system for internal combustion engines, to which the method of the present invention is applicable. Reference numeral 1 designates a multi-cylinder type internal combustion engine which may have four cylinders 1*a*, for instance. This engine 1 has main combustion chambers which may be four in number and sub combustion chambers communicating with the main combustion chambers, none of which is shown. An intake pipe 2 is connected to the engine 1, which comprises a main intake pipe communicating with each main combustion chamber, and a sub intake pipe with each sub combustion chamber, respectively, neither of which is shown. Arranged across the intake pipe 2 is a throttle body 3 which accommodates a main throttle valve and a sub throttle valve mounted in the main intake pipe and the sub intake pipe, respectively, for synchronous operation. Neither of the two throttle valves is shown. A throttle valve opening sensor 4 is connected to the main throttle valve for detecting its valve opening and converting same into an electrical signal which is supplied to an electronic control unit (hereinafter called "ECU") 5 in which is incorporated the CPU 5*a*.

A fuel injection device 6 is arranged in the intake pipe 2 at a location between the engine 1 and the throttle body 3, which comprises main injectors and a subinjector, none of which is shown. The main injectors correspond in number to the engine cylinders and are each arranged in the main intake pipe at a location slightly upstream of an intake valve, not shown, of a corresponding engine cylinder, while the subinjector, which is single in number, is arranged in the sub intake pipe at a location slightly downstream of the sub throttle valve, for supplying fuel to all the engine cylinders. Although the subinjector is usually arranged in a non-diverged or common portion of the sub intake pipe which is formed by an intake manifold, such subinjector may be arranged in each of the diverged portion of the sub intake pipe, instead. The fuel injection device 6 is connected to a fuel pump, not shown. The main injectors and the subinjector are electrically connected to the ECU 5 in a manner having their valve opening periods or fuel injection quantities controlled by signals supplied from the ECU 5.

On the other hand, an absolute pressure sensor (hereinafter called "the PBA sensor") 8 communicates through a conduit 7 with the interior of the main intake pipe of the throttle body 3 at a location immediately downstream of the main throttle valve. The PBA sensor 8 is adapted to detect absolute pressure in the intake pipe 2 and applies an electrical signal indicative of detected absolute pressure to the ECU 5.

Figure 3:
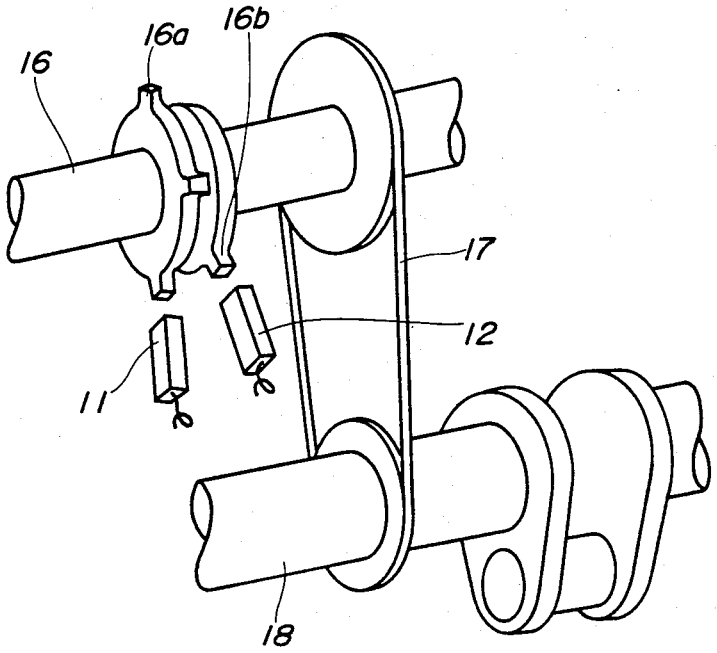
FIG. 3 is a schematic perspective view of the engine rpm sensor (TDC sensor) and the cylinder-discriminating sensor appearing in FIG. 2.

An engine rpm sensor (hereinafter called "the TDC sensor") 11 and a cylinder-discriminating sensor 12 are electrically connected to the ECU 5 for supplying their output signals thereto. As shown in FIG. 3, these sensors 11, 12 are composed of electromagnetic pickups arranged, respectively, in facing relation to four protuberances 16*a* corresponding in number to the cylinders 1*a* and a single protuberance 16*b* formed integrally on respective magnetic discs secured on a camshaft 16 of the engine 1, which is arranged to be rotatively driven by a crankshaft 18 of the same engine with a reduction ratio of 1 : 2, via a timing belt 17. The TDC sensor 11 is adapted to generate a pulse indicative of a predetermined position of a piston in each of different cylinders of the engine relative to a top dead center of the piston, that is, one pulse at a particular crank angle each time the engine crankshaft rotates through 180 degrees, while the cylinder-discriminating sensor 12 is adapted to generate one pulse each time the crankshaft of the engine rotates through a predetermined angle with respect to a predetermined position of the piston in a particular cylinder. The above pulses generated by the sensors 11, 12 are supplied to the ECU 5.

Further connected to the ECU 5 is a starter switch 13 for turning on and off a starter, not shown, provided in the engine, and an ignition switch 14 for turning on and off an ignition device, not shown, provided in the engine. A power source 15 which is formed by a battery is connected by way of the ignition switch 14 to the ECU 5. Thus, the ECU 5 is supplied with a signal indicative of the supply voltage of the battery 15 as well as signals indicative of on-off positions of the starter switch 13 and the ignition switch 14.

The TDC sensor 11 and the cylinder-discriminating sensor 12 may be formed in a single body but adapted to generate respective signals independently of each other. For example, these sensors may be comprised of magnetic protuberances circumferentially arranged around the camshaft along a common diametrical plane, which are inclusive of a magnetic protuberance longer or with a larger radial height than the others, for discrimination of a particular cylinder and correspond in number to the number of the cylinders, and a single electromagnetic pickup disposed in facing relation to these protuberances. The position of the above particular cylinder is discriminated by detecting a pulse having a larger amplitude which is generated when the longer magnetic protuberance passes by the electromagnetic pickup, while the rotational speed of the engine is determined by detecting pulses having a smaller amplitude which are generated when the shorter magnetic protuberances pass by the same pickup. Further alternatively of the above longer protuberance, a magnetic protuberance having the same radial height as the other protuberances may be arranged closer to one of the other protuberances so that the rotational speed of the engine is determined by detecting pulses generated with uniform pulse separations while the position of the particular cylinder is determined by detecting preceding one of two adjacent pulses having a pulse separation shorter than the above pulse separations.

The ECU 5 operates on the aforementioned various signals indicative of engine operation parameters to determine the operating conditions of the engine, and at the start of the engine, calculate the fuel injection period TOUT of the fuel injection device 6 by the use of the following equations, in accordance with the determined operating conditions of the engine:

$$TOUTM = TiCRM \times KNe + (TV + \Delta TV) \quad (1)$$

$$TOUTS = TiCRS \times KNe + TV \quad (2)$$

where TiCRM, TiCRS represent basic values of the valve opening periods for the main injectors and the subinjector, respectively, which are determined from a TiCRM table and a TiCRS table, respectively, on the basis of a value of the rotational speed of the engine detected by the TDC sensor 11 and a value of the intake pipe absolute pressure detected by the PBA sensor 8, KNe represents a correction coefficient applicable at the start of the engine, which is variable as a function of engine rpm Ne and determined from a KNe table, and TV represents a constant for increasing and decreasing the valve opening period in response to changes in the output voltage of the battery, which is determined from a TV table. $\Delta TV$ is added to TV applicable to the main injectors as distinct from TV applicable to the subinjector, because the main injectors are structurally different from the subinjector and therefore have different operating characteristics.

Figure 4:
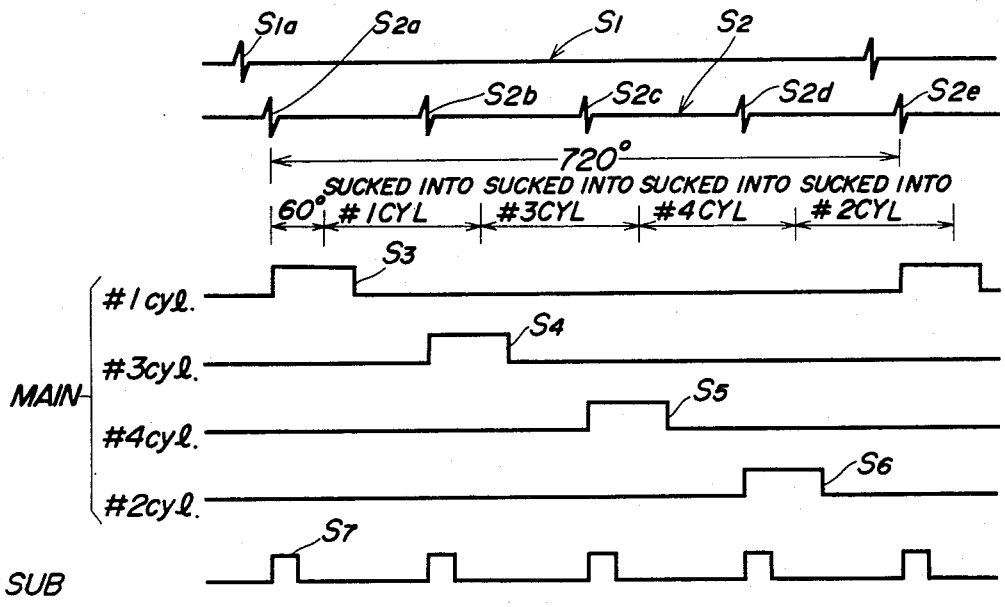
FIG. 4 is a timing chart showing the relationship between a cylinder-discriminating signal and a TDC signal inputted to the ECU in FIG. 2, and drive signals for the main injectors and the subinjector, outputted from the ECU.

FIG. 4 is a timing chart showing the relationship between the cylinder-discriminating signal and the TDC signal, both inputted to the ECU 5 when the engine is operating in a normal steady operating condition other than in a starting condition, and the driving signals outputted from the ECU 5 for driving the main injectors and the subinjector. The cylinder-discriminating signal $S_1$ is inputted to the ECU 5 in the form of a pulse $S_1a$ each time the engine crankshaft rotates through 720 degrees. Pulses $S_2a$–$S_2e$ forming the TDC signal $S_2$ are each inputted to the ECU 5 each time the engine crankshaft rotates through 180 degrees. The relationship in timing between the two signals $S_1$, $S_2$ determines the output timing of driving signals $S_3$–$S_6$ for driving the main injectors of the four engine cylinders. More specifically, the driving signal $S_3$ is outputted for driving the main injecor of the first engine cylinder, concurrently with the first TDC signal pulse $S_2$a, the driving signal $S_4$ for the third engine cylinder concurrently with the second TDC signal pulse $S_2$b, the driving signal $S_5$ for the fourth cylinder concurrently with the third pulse $S_2$c, and the driving signal $S_6$ for the second cylinder concurrently with the fourth pulse $S_2$d, respectively. The subinjector driving signal $S_7$ is generated in the form of a pulse upon application of each pulse of the TDC signal to the ECU 5, that is, each time the crankshaft rotates through 180 degrees. It is so arranged that the pulses $S_2$a, $S_2$b, etc. of the TDC signal are each generated earlier by 60 degrees than the time when the piston in an associated engine cylinder reaches its top dead center, so as to compensate for arithmetic operation lag in the ECU 5, and a time lag between the formation of a mixture and the suction of the mixture into the engine cylinder, which depends upon the opening action of the intake pipe before the piston reaches its top dead center and the operation of the associated injector.

Figure 5:
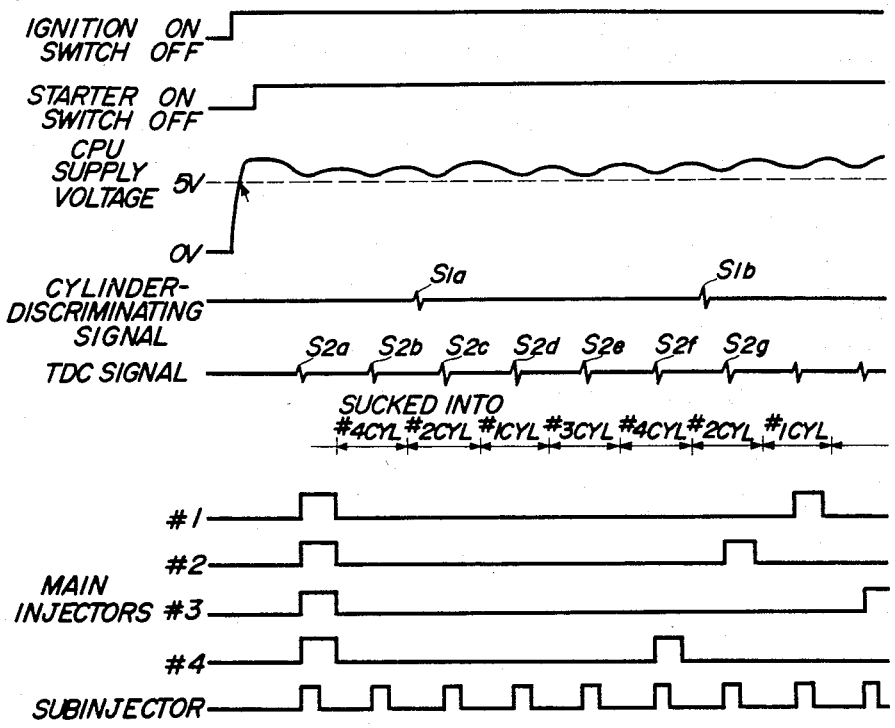
FIG. 5 is a timing chart showing how fuel injections are effected according to the first control manner selected when the starter switch is in an open position during initialization of the CPU.

Next, the manner of controlling the fuel injection at the start of the engine according to the invention will now be explained with reference to FIGS. 5 and 6. So long as the supply voltage to the CPU 5*a* remains above a lower limit of a range within which the CPU 5*a* can normally operate, the CPU 5*a* is reset immediately when the ignition switch 14 is turned on or closed, and instantly it becomes initialized. During this initilization of the CPU 5*a*, that is, within a predetermined period of time (e.g. 40 ms) from the closing of the ignition switch 14, a signal indicative of the on-off position of the starter switch 13 is inputted to the CPU 5*a*. However, according to an ordinary engine starting operation made by the driver, usually the starter switch 13 is not closed within a time of 50 ms after the ignition switch 14 has been closed. Therefore, usually, a signal indicative of the starter switch position which is first inputted to the CPU 5*a* after closing of the ignition switch 14 will indicate the off position of the starter switch 13. According to the invention, on this occasion, that is, before the supply of electric power to the starter is effected, the CPU 5*a* supplies driving signals to all the main injectors #1–4 at the same time immediately when a first pulse $S_2$a of the TDC signal is inputted to the CPU 5*a* after the ignition switch 14 has been closed, to thereby concurrently effect fuel injections into all the cylinders, as according to the aforementioned proposed method. Then, from the time a pulse $S_2$f of of the TDC signal is inputted to the CPU 5*a*, which is an n+1)th from the above first pulse $S_2$a, n being the number of the cylinders, i.e. 4, driving signals are successively supplied to the respective main injectors in predetermined sequence in synchronism with inputting of subsequent pulses of the TDC signal to the CPU 5*a* (FIG. 5). Alternatively of this successive fuel injections, another manner of fuel injection may be employed. For example, fuel injections are effected into two cylinders at the same time, following by concurrent fuel injections into the other two cyliders.

Figure 6:
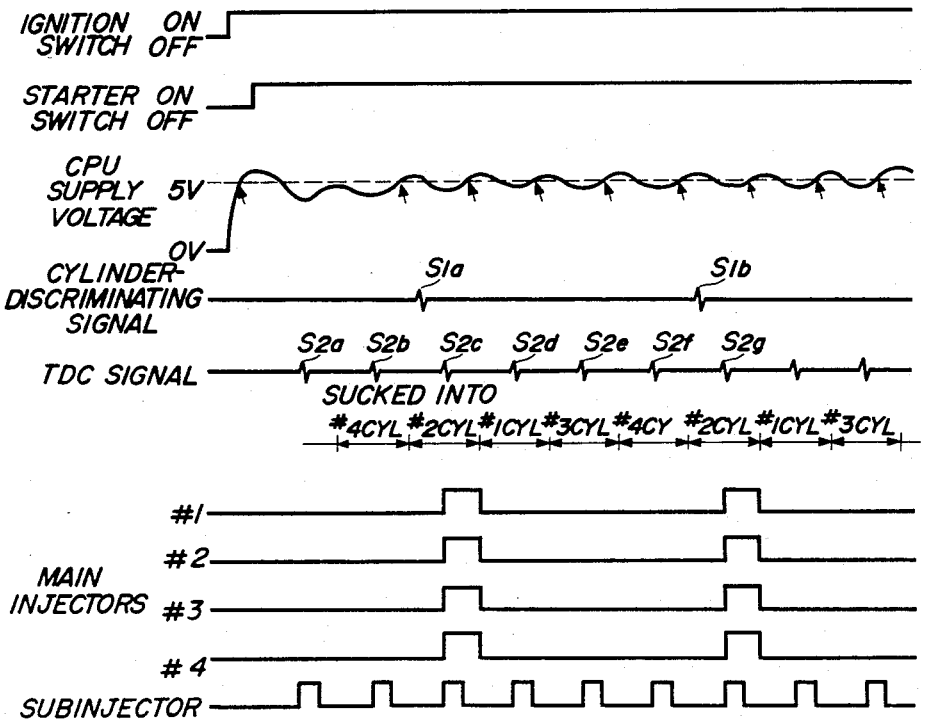
FIG. 6 is a timing chart showing how fuel injections are effected according to the second control manner selected when the starter switch is in a closed position during initialization of the CPU.

On the other hand, when the engine is started under a low temperature condition such as in cold weather of if the battery has a small residual electric charge at the start of the engine, the supply voltage applied to the CPU 5*a* can frequently drop below the lower limit of the normally operable range as shown in FIG. 6. Each time the supply voltage once dropped rises across the above lower limit as indicated by the arrows in FIG. 6, the CPU 5*a* is intialized. The signal indicative of the on-off position of the starter switch 13 which is inputted to the CPU 5*a* during such initialization will indicate that the same switch 13 is then in a closed position. In this case, according to the invention, all the injectors are actuated to inject fuel into all the cylider at the same time upon inputting of a pulse $S_2$c of the TDC signal to the CPU 5*a*, which immediately follows a first pulse $S_1$a of the cylinder-discriminating signal after closing of the ignition switch 14. After this, all the injectors are again actuated to inject fuel into all the cylinders at the same time upon inputting of a pulse $S_2$g of the TDC signal to the CPU 5*a*, which immediately follows a pulse $S_1$b of the cylinder-discriminating signal immediately following the first pulse $S_1$a. When the program executed by the CPU 5*a* proceeds to a basic control routine, following completion of the present start control routine wherein the above manner of fuel injection is effected as shown in FIG. 6, fuel injections are successively effected into the cylinders in predetermined sequence in synchronism with inputting of pulses of the TDC signal to the CPU 5*a*, starting from the time of inputting a pulse of the TDC signal to the CPU 5*a*, which immediately follows a pulse of the cylinder-discriminating signal detected immediately after the above proceeding to the basic control routine. Whichever of the two manners shown in FIGS. 5 and 6 is employed, the subinjector is supplied with a driving signal to effect fuel injection each time a pulse of the TDC signal is inputted to the CPU 5*a*.

Figure 7:
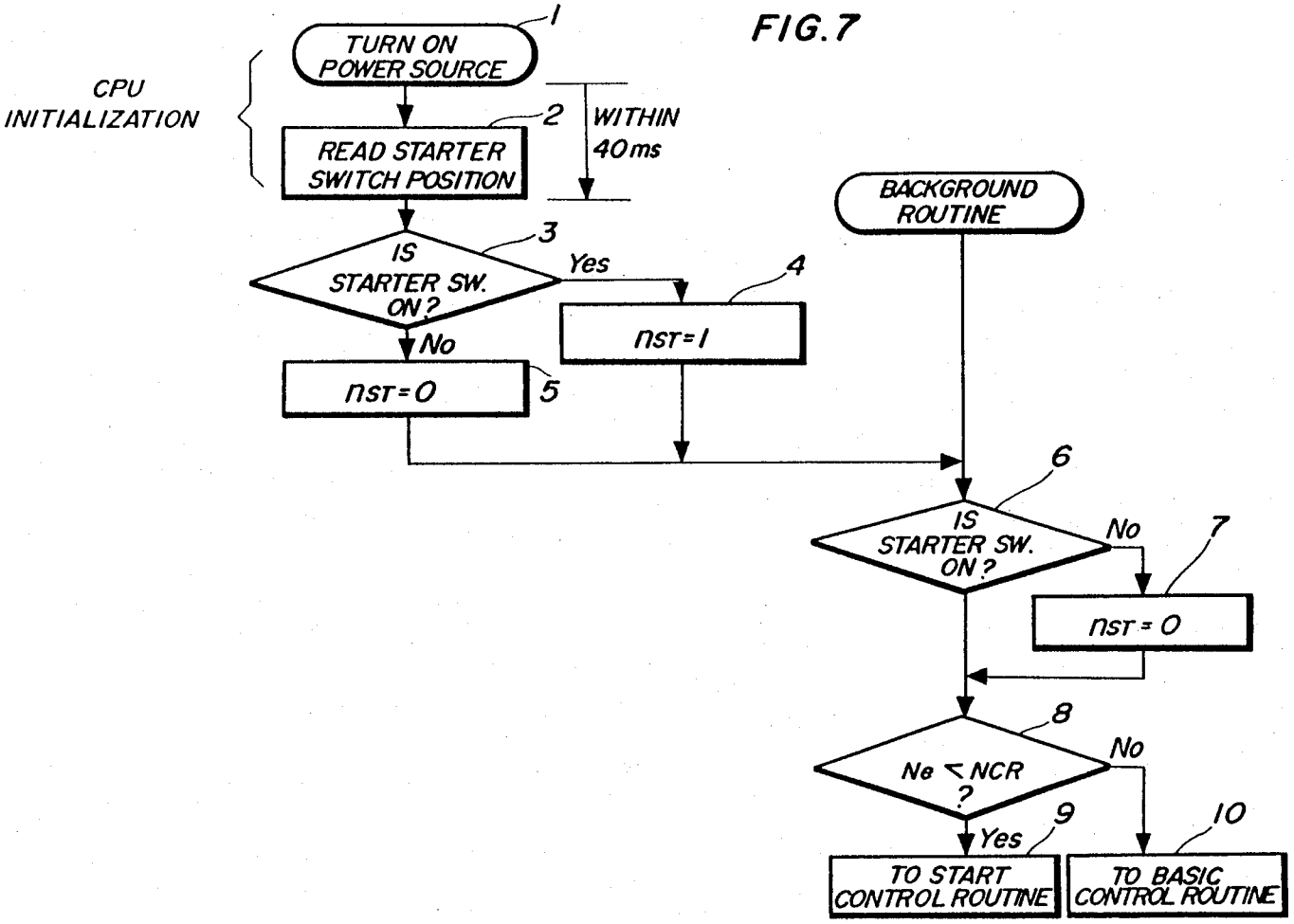
FIG. 7 is a subroutine for determining the position of the starter switch at the start of the engine.

FIG. 7 is a flow chart showing a routine for determining the on-off position of the starter switch 13 assumed at the start of the engine. First, the power source of the CPU 5*a* is turned on at the step 1. That is, the supply voltage from the battery 15 in FIG. 2 is applied to the CPU 5*a*, which is above the predetermined level of 5 volts. The turning-on of the power source at the step 1 is realized either when the ignition switch 14 is closed to apply the supply voltage to the CPU 5*a* or when the supply voltage supplied to the CPU 5*a* rises across the above predetermined level after once having dropped below the same predetermined level after closing of the ignition switch. Then, it is determined at the step 2 whether or not the starter switch 13 in FIG. 2 is in a closed position, from a signal indicative of the on-off position of the same switch 13 and inputted to the CPU 5*a* within a predetermined period of time (e.g. 40 ms) from the time of turning-on of the power source determined at the step 1. The above predetermined period of time (40 ms) is set smaller than a period of time which usually elapses from closing of the ignition switch 14 to closing of the starter switch 13. Therefore, usually a signal indicative of the on-off position of the starter switch 13 necessarily shows an off position of the same switch, which is inputted within the above predetermined period of time (40 ms) from the time of turning-on of the power source of the CPU 5*a* which is realized by closing of the ignition switch 14 (that is, the initially reset time of the CPU 5*a*). As a result, the answer to the question of the step 3 is no. On the other hand, a signal indicative of the position of the starter switch 13 can show an on position of the same switch, which is inputted within the predetermined period of time (40 ms) from the time the CPU 5*a* starts to be initialized upon the supply voltage rising across the predetermined level (5 volts) after once having dropped below the same level during the starting operation of the engine. If the answer to the question of the step 3 is yes, that is, if the starter switch is determined to be in a closed position, the value of a flag signal NST is set to 1 at the step 4, which commands concurrent fuel injections into all the cylinders in synchronism with a pulse of the TDC signal inputted immediately after inputting of a pulse of the cylinder-discriminating signal, hereinafter referred to. If the answer to the question of the step 3 is no, the value of the flag signal NST is set to 0 at the step 5.

In the execution of a background routine which is executed unless it is interrupted by another routine, which follows the execution of the above steps 1–5, a determination as to the on-off position of the starter switch 13 is repeatedly executed at the step 6. If the starter switch is determined to be on or closed, it is then determined at the step 8 whether or not the rotational speed Ne of the engine is lower than a predetermined cranking speed (e.g. 400 rpm). If the answer to the question of the step 8 is yes, a start control routine will be executed, as hereinafter described (step 9).

On the other hand, if the answer to the question of the step 6 is no, that is, if the starter switch is determined to be opened, the value of the flag signal NST is set to 0. If at the step 8 it is determined that the engine rotational speed Ne has exceeded the predetermined cranking speed, it is judged that the control in start cotrol mode has been completed, and then the program proceeds to the control in basic control mode, at the step 10.

Figure 8:
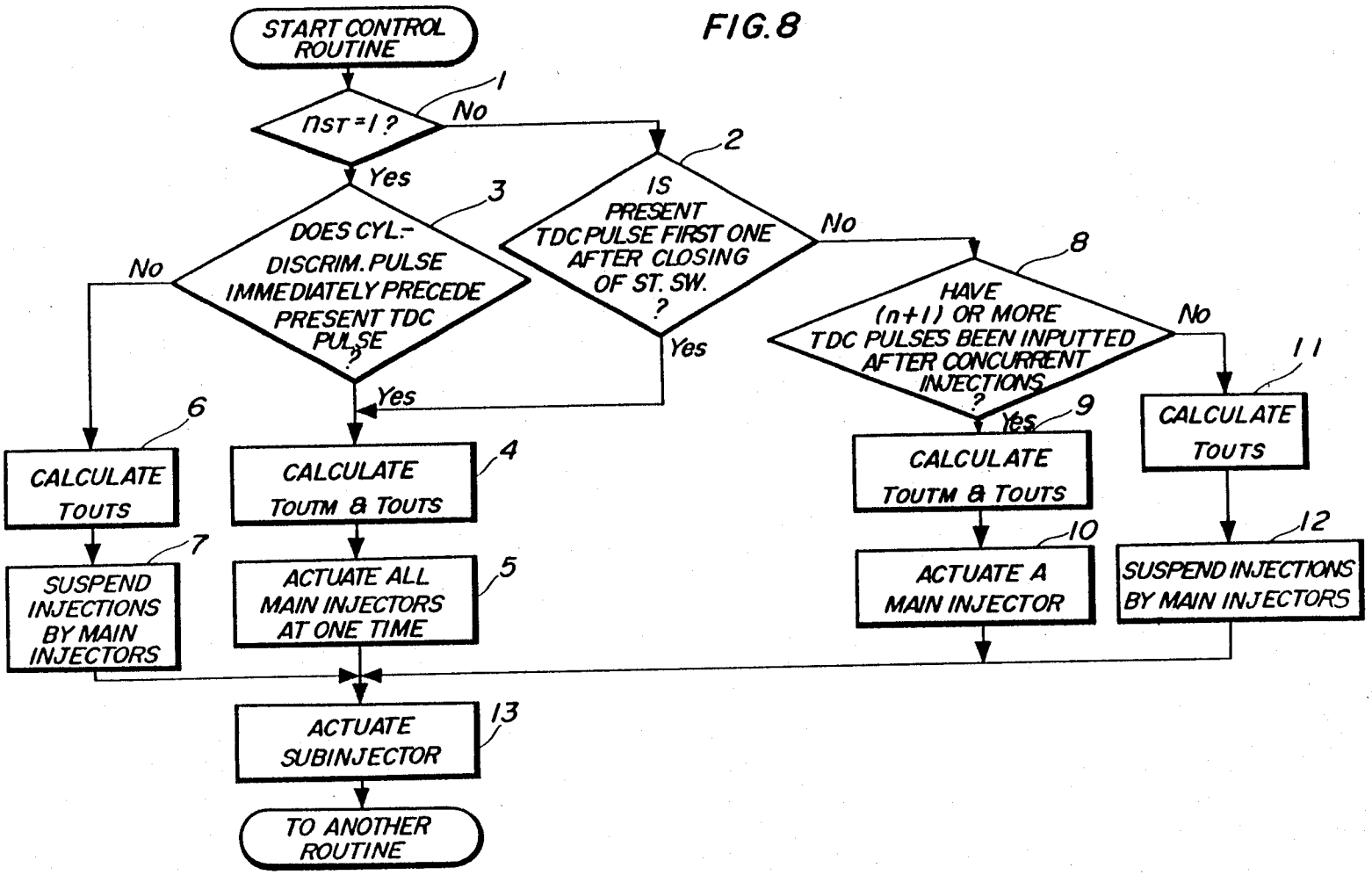
FIG. 8 is a flow chart showing a routine for controlling the fuel injection at the start of the engine.

FIG. 8 is a flow chart of a routine for controlling the fuel injection at the start of the engine, which is commanded by the flag signal NST, referred to above. First, it is determined at the step 1 whether or not the value of the flag signal NST is 1. If the answer is no, that is, if a signal indicative of the position of the starter switch 13 shows an off position of same, which is inputted during initialization of the CPU 5*a* within the predetermined period of time (40 ms) from the time of turning-on of the CPU 5*a*, it is then determined at the step 2 whether or not a pulse of the TDC signal inputted immediately after the determination of the step 1 is a first one after the starter switch 13 has shifted to an on position afterwards. If the answer is yes, values of the fuel injection periods TOUTM, TOUTS applicable at the start of the engine are calculated by the use of the aforementioned equations (1), (2), at the step 4, and all the main injectors are actuated at the same time to inject fuel into all the cylinders, at the step 5, and simultaneously the subinjector is actuated to inject fuel into one of the cylinders at the step 13. If the answer to the question of the step 2 is no, it is determined at the step 8 whether or not pulses of the TDC signal have been inputted, which are equal in number to the sum of the number of the cylinders or 4 and 1, after inputting of the pulse of the TDC signal when the above concurrent fuel injections through all the main injectors were effected. If the answer is yes, values of the fuel injection periods TOUTM, TOUTS are calculated according to the equations (1), (2), at the step 9, and fuel injections are successively carried out through the main injectors in synchronism with inputting of subsequent pulses of the TDC signal starting from inputting of the pulse of the TDC signal when the affirmative answer to the step 8 has been obtained, at the step 10, while on the other hand, the subinjector is actuated to inject fuel into one of the cylinders upon inputting of each pulse of the TDC signal, at the step 13. So long as the answer to the question of the 8 is no, that is, until a number of pulses of the TDC signal corresponding to the sum of the number of the cylinders and 1 are inputted to the CPU 5*a* after the above concurrent fuel injections through all the main injectors, a value of the fuel injection period TOUTS for the subinjector alone is calculated for one of the cylinders at the step 11, and a fuel injection is effected through the subinjector in synchronism with inputting of each pulse of the TDC signal at the step 13, while simultaneously the fuel injections through the main injectors are suspended at the step 12.

On the other hand, if the value of the flag signal NST is determined to be 1 at the step 1, it is determined at the step 3 whether a pulse of the cylinder-discriminating signal immediately before the same determination was inputted between a pulse of the TDC signal inputted in the present loop and a pulse of the TDC signal inputted in the preceding loop, or was inputted between the initialization of the CPU 5*a* and the above pulse of the TDC signal inputted in the present loop. This is to determine whether or not the pulse of the TDC signal inputted in the present loop was inputted immediately after inputting of the pulse of the cylinder-discriminating signal. If the same pulse of the cylinder-discriminating signal is determined to satisfy the above condition, the aforementioned steps 4, 5 and 13 are executed. That is, values of the fuel injection periods TOUTM, TOUTS are calculated in synchronism with inputting of the pulse of the TDC signal inputted in the present loop, and fuel injections are carried out through all the main injectors and through the subinjector at the same time. If the answer to the question of the step 3 is no, a value of the fuel injection period TOUTS for the subinjector alone is calculated at the step 6 to inject fuel into the subinjector at the step 13, while on the other hand, no fuel injection is carried out through any of the main injectors (step 7). If the condition of $Ne > NCR$ is satisfied after execution of the above steps, the program proceeds to the basic control routine.

Figure 9:
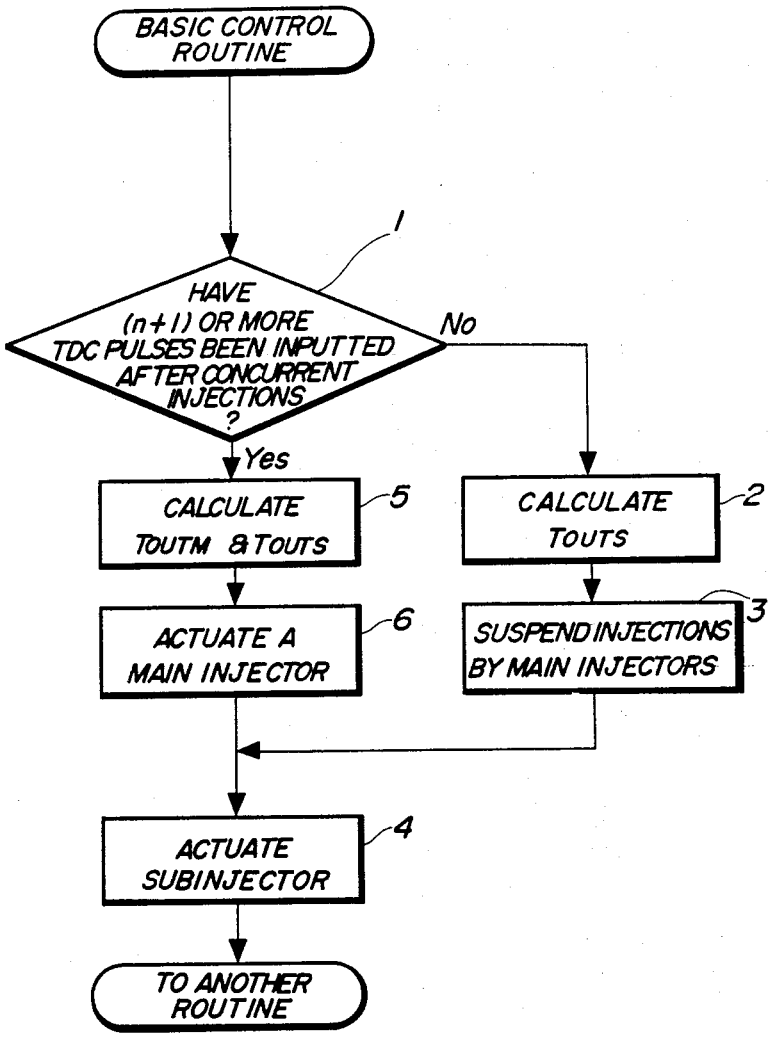
FIG. 9 is a flow chart showing a routine for controlling the fuel injection into the main injectors, which is executed immediately following the routine of FIG. 8.

FIG. 9 shows a subroutine for controlling fuel injections through the main injectors, which forms part of the basic control routine. At the step 1, it is determined whether or not a pulse of the TDC signal inputted in the present loop is an $(n+1)$th pulse after the pulse of the TDC signal, on the basis of which were effected the aforementioned concurrent fuel injections through all the main injectors at the step 5 in FIG. 8, n being the number of the cylinders. If the answer is no, a value of the fuel injection period TOUTS for the subinjector alone is calculated at the step 2 to inject fuel through the subinjector at the step 4, while on the other hand, fuel injection through each main injector is suspended at the step 3. If the answer is yes, in synchronism with inputting of each pulse of the TDC signal starting from the time of inputting of the above $(n+1)$th pulse of the TDC signal, values of the fuel injection periods TOUTM, TOUTS are calculated and the main injectors are successively actuated to inject fuel into the cylinders at the step 6 as well as the subinjector at the step 4.

Figure 10:
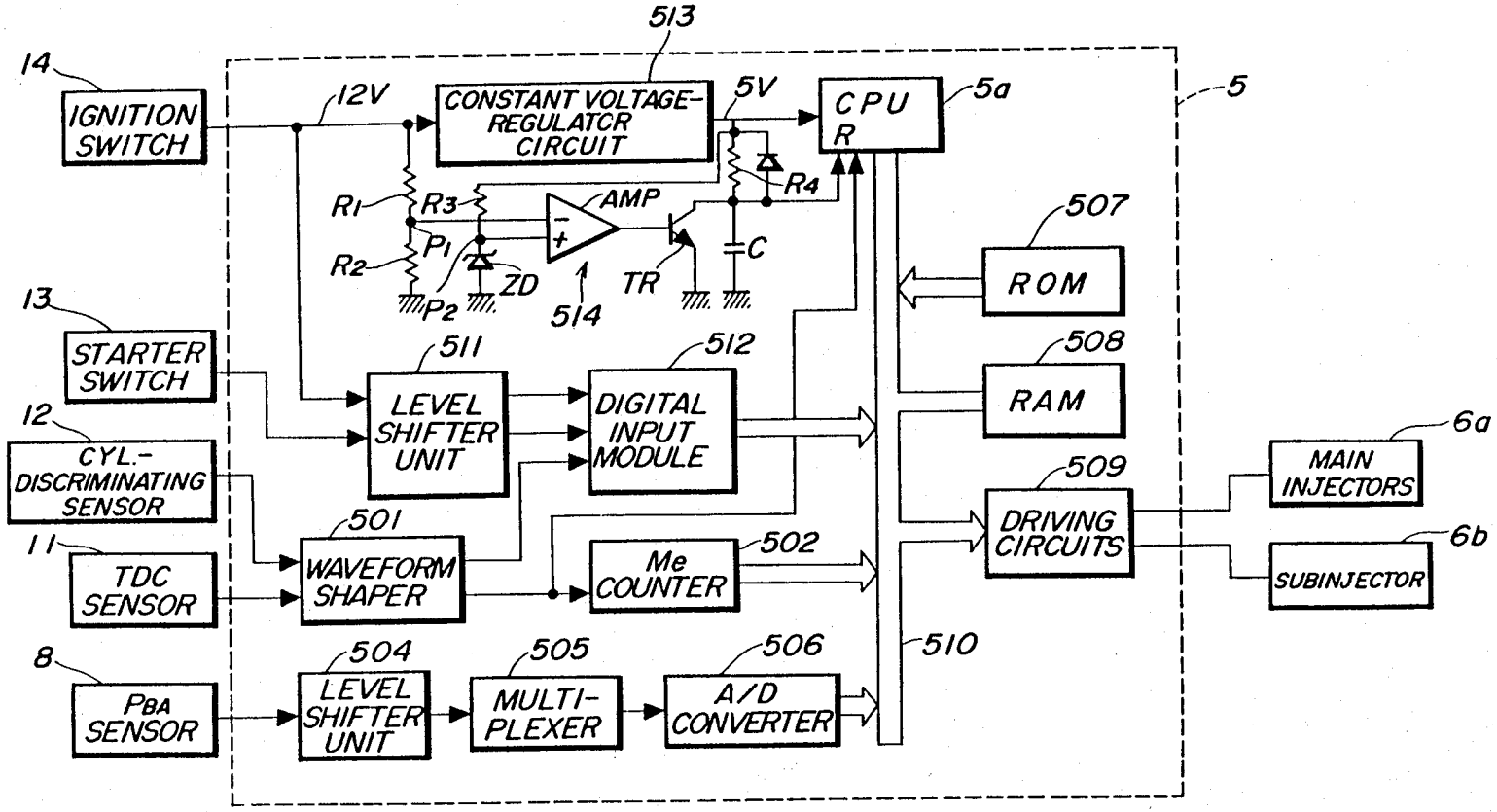
FIG. 10 is a circuit diagram showing an example of the interior construction of the ECU.

FIG. 10 is a block diagram showing an electrical circuit within the ECU 5 in FIG. 2. The engine rpm signal from the TDC sensor 11 in FIG. 2 is applied to a waveform shaper 501, wherein it has its pulse waveform shaped, and supplied to an Me value counter 502 as well as to the CPU 5*a* as a TDC signal. The Me value counter 502 counts the interval of time between adjacent pulses of the engine rpm signal generated at predetermined crank angles of the engine, inputted thereto from the TDC sensor 11, and therefore its counted value Me corresponds to the reciprocal of the actual engine rpm Ne. The Me value counter 502 supplies the counted value Me to the CPU 5*a* via a data bus 510.

The respective output signals from the various sensors such as the intake pipe absolute pressure sensor 8, all appearing in FIG. 2, and other engine operation parameter sensors, not shown, have their voltage levels shifted to a predetermined voltage level by a level shifter unit 504 and applied successively to an analog-to-digital converter (hereinafter called "A/D converter") 506 through a multiplexer 505. The A/D converter 506 successively converts the above signals into digital signals and supplies them to the CPU 5*a* via the data bus 510. The signals indicative of the on-off positions of the starter switch 13 and the ignition switch 14 are also converted into a predetermined voltage level by another level shifter unit 511 and supplied to the CPU 5*a* through a digital input module 512 and the data bus 510.

The CPU 5*a* is also connected to a read-only memory (hereinafter called "ROM") 507, a random access memory (hereinafter called "RAM") 508, and driving circuits 509, through the data bus 510. The ROM 507 stores a control program executed within the CPU 5*a*, maps of basic fuel injection periods for the main injectors 6*a* and the subinjector 6*b*, etc., while the RAM 508 temporarily stores the resultant values of various calculations from the CPU 5*a*. The CPU 5*a* executes the control program stored in the ROM 507 in synchronism with inputting of pulses of the TDC signal thereto to calculate the valve opening periods TOUTM, TOUTS for the main injectors 6*a* and the subinjector 6*b* on the basis of values of the aforementioned various engine operation parameter sensors and supplies the calculated TOUTM and TOUTS values to the driving circuits 509 via the data bus 510. The driving circuits 509 supply driving signals corresponding to the above TOUTM and TOUTS values to the main injectors 6*a* and the subinjector 6*b* to energize same.

The ignition switch 14 is connected to the CPU 5*a* through a constant voltage-regulator circuit 513 in a manner such that when the ignition switch 14 is closed, the output voltage (e.g. 12 volts) from the battery 15 in FIG. 2 is supplied through the closed switch 14 to the constant voltage-regulator circuit 513, which in turn supplies a regulated constant level voltage (e.g. 5 volts) to the CPU 5*a*. A resetting circuit 514 is connected to the CPU 5*a* in parallel with the constant voltage-regulator circuit 513. This resetting circuit 514 is adapted to reset the CPU 5*a* as long as the voltage applied to the constant voltage-regulator circuit 513 is below a certain level. The resetting circuit 514 is comprised of an amplifier AMP which has an inverting input terminal connected to the junction of voltage-dividing resistances R1, R2 serially connected between the input of the constant voltage-regulator circuit 513 and the ground, and a non-inverting input terminal connected to the junction of a Zener diode ZD and a resistance R3 serially connected between the output of the circuit 513 and the ground. A transistor TR is connected at the base to the output of the amplifier AMP, and at the collector to one end of a resistance R4 which has its other end connected to the output of the circuit 513, respectively, while its emitter is grounded. Connected between the one end of the resistance R4 and the ground is a capacitor C, the junction of the capacitor C with the resistance R4 being connected to a reset pulse input terminal R of the CPU 5*a*.

When the ignition switch 14 is closed, the constant voltage-regulator circuit 513 generates an output voltage regulated to the above preset voltage level (5 volts) and supplies same to the CPU 5*a*. However, due to the charging action of the capacitor C, the terminal voltage of the capacitor C (i.e. the potential at the junction of the capacitor C with the resistance R4) does not rise instantly upon closing of the ignition switch 14 to keep the CPU 5*a* reset for a predetermined period of time. When the terminal voltage of the capacitor C rises to a predetermined reset-releasing voltage afterwards, the CPU 5*a* is released from its reset state, and then initialized. Usually, upon completion of this initialization, the CPU 5*a* starts execution of the aforementioned control actions. When the starter switch 13 is closed while the engine is starting in a cold condition, the voltage (12 volts) supplied to the constant voltage-regulator circuit 513, which is not regulated, can drop below a certain level. The potential P1 at the junction of the resistances R1, R2 is set at a level higher than the potential P2 at the junction of the Zener diode ZD with the resistance R3 so long as the non-regulated voltage supplied to the circuit 513 has a normal level or 12 volts, and then the output level from the amplifier AMP is low or 0 to keep the transistor TR in a non-conducting state whereby the collector voltage or the terminal voltage of the capacitor C is kept at the predetermined reset-releasing voltage level to keep the CPU 5*a* from being reset. When the above non-regulated voltage supplied to the circuit 513 drops so that the potential P1 accordingly drops below the potential P2, the output level from the amplifier AMP rises to cause the transistor TR to conduct, whereby the collector voltage drops down to 0. While the collector voltage remains at this level of 0, the CPU 5*a* is kept reset. When the non-regulated voltage inputted to the constant voltage-regulator circuit 513 recovers its normal level so that the potential P1 is restored to a level above the potential P2 set by the Zener diode ZD, the transistor TR returns into a non-conducting state, and consequently the CPU 5*a* is kept reset until the potential at the junction of the resistance R4 with the capacitor C or the terminal voltage of the latter rises up to the predetermiend reset-releasing level. Upon the predetermined reset-releasing level being reached, the CPU 5*a* is releasted from its reset state and starts to be initialized. If fluctuations occur in the non-regulated voltage supplied to the constant voltage-regulator circuit 513 as it is dropping so that the transistor TR is alternately turned on and off repeatedly, such fluctuations are absorbed by the combination of the resistance R4 and the capacitor C, if the repetition period of turning-on and -off of the transistor TR is shorter than the time constant of the same combination, to provide a stable reset-releasing voltage.

After having been initialized as described above, the CPU 5*a* determines the on-off positon of the starter switch 13 in the manner described previously, to select one of a plurality of different manners of controlling the fuel injection at the start of the engine, depending upon the on-off position of the switch 13, for instance, the two control manners as shown in FIGS. 5 and 6, and controls the driving circuits 509 to drive the main injectors 6*a* in accordance with the control manner thus selected.

Although in the embodiment of FIG. 10, detection of a drop in the supply voltage to the CPU 5*a* is made by detecting the non-regulated voltage being inputted to the constant voltage-regulator circuit 513, it may be made by detecting a drop in the output voltage from the circuit circuit 513.

What is claimed is:

1. A method for controlling the operation of an internal combustion engine having an ignition switch and a starter switch, while it is in a starting condition, by means of a control system including a central processing unit which is supplied with an operating voltage from a power source while said ignition switch of said engine is closed, and adapted to normally operate with an operating voltage above a predetermined level, the method comprising the steps of: (1) detecting the value of said operating voltage being supplied from said power source to said central processing unit; (2) initializing said central processing unit when said operating voltage increases above said predetermined level after said ignition switch has been closed; (3) determining whether said starter switch of said engine is in a closed position or in an open position while said central processing unit is being initialized; (4) selecting one of a plurality of predetermined manners of controlling the operation of said engine while it is in said starting condition, depending upon the result of said determination in said step (3); and (5) controlling the operation of said engine while it is in said starting condition, in accordance with said one manner selected in said step (4).

2. A method for controlling the injection of fuel into an internal combustion engine having a plurality of cylinders, an ignition switch and a starter switch, while it is in a starting condition, by means of a fuel injection control system including a central processing unit which is supplied with an operating voltage from a power source while said ignition switch of said engine is closed, and adapted to normally operate with an operating voltage above a predetermined level, the method comprising the steps of: (1) detecting the value of said operating voltage being supplied from said power source to said central processing unit; (2) initializing said central processing unit when said operating voltage increases above said predetermined level after said ignition switch has been closed; (3) determining whether said starter switch of said engine is in a closed position or in an open position while said central processing unit is being initialized; (4) selecting one of a plurality of predetermined manners of controlling the injection of fuel into said engine while it is in said starting condition, depending upon the result of said determination in said step (3); and (5) controlling the injection of fuel into said engine while it is in said starting condition, in accordance with said one manner selected in said step (4).

3. A method as claimed in claim 2, wherein said engine includes a plurality of cylinders, each having a piston disposed therein, said fuel injection control system including a top-dead-center sensor adapted to generate a pulse indicative of a predetermined position of said piston in each of said cylinders of said engine relative to a top dead center of said piston, said plurality of predetermined manners of controlling the injection of fuel into said engine including a first manner of effecting fuel injections into all of said cylinders at the same time in synchronism with inputting of a first pulse outputted from said top-deadcenter sensor to said central processing unit after completion of said initialization thereof.

4. A method as claimed in claim 3, wherein in said step (4) said first manner is selected when it is determined in said step (3) that said starter switch is in said open position while said central processing unit is being initialized.

5. A method as claimed in claim 3 or claim 4, further including the step of successively effecting fuel injections into said cylinders of said engine in synchronism with inputting of pulses outputted from said top-dead-center sensor to said central processing unit, after said fuel injections have been effected according to said first manner selected.

6. A method as claimed in claim 5, wherein said successive fuel injections following said fuel injections according to said first manner are started immediately after a number of pulses outputted from said top-dead-center sensor have been inputted to said central processing unit after said inputting of said first pulse from said top-dead-center sensor thereto, which corresponds to the sum of the number of said cylinders of said engine and 1.

7. A method as claimed in claim 2, wherein said engine includes a plurality of cylinders, each having a piston disposed therein, and a crankshaft connected to said piston of each of said cylinders, said fuel injection control system including a cylinder-discriminating sensor adapted to generate a pulse each time said crankshaft of said engine rotates through a predetermined angle with respect to a predetermined position of said piston in a particular one of said cylinders of said engine, said plurality of predetermined manners of controlling the injection of fuel into said engine including a second manner of effecting fuel injections into all of said cylinders at the same time in synchronism with inputting of a first pulse outputted from said cylinder-discriminating sensor to said central processing unit after completion of said initialization thereof.

8. A method as claimed in claim 7, wherein in said step (4) said second manner is selected when it is determined in said step (3) that said starter switch is in said closed position while said central processing unit is being initialized.

9. A method as claimed in claim 7 or claim 8, wherein said fuel injection control system includes a top-dead-center sensor adapted to generate a pulse indicative of a predetermined position of said piston in each of said cylinders of said engine relative to a top dead center of said piston, the method further including the step of successively effecting fuel injections into said cylinders of said engine in synchronism with inputting of pulses outputted from said top-dead-center sensor to said central processing unit, after said fuel injections have been effected according to said second manner selected.

10. A method as claimed in claim 9, wherein said successive fuel injections following said fuel injections according to said second manner are started immediately after a number of pulses outputted from said top-dead-center sensor have been inputted to said central processing unit after inputting of a first pulse from said top-dead-center sensor thereto after completion of said initialization of said central processing unit, which corresponds to the sum of the number of said cylinders of said engine and 1.

11. A method as claimed in any of claims 2–4, 6–8 and 10, further including the step of determining that said engine is in said starting condition, when said starter switch is in said closed position and at the same time the rotational speed of said engine is lower than a predetermined value of rpm.

* * * * *